United States Patent [19]

Teranishi

[11] 4,377,121

[45] Mar. 22, 1983

[54] BOBBIN CASE

[75] Inventor: Shunichi Teranishi, Anjo, Japan

[73] Assignee: Aisin Seiki Kabushiki Kaisha, Kariya, Japan

[21] Appl. No.: 245,043

[22] Filed: Mar. 18, 1981

[30] Foreign Application Priority Data

Mar. 28, 1980 [JP] Japan ..... 55-041700[U]

[51] Int. Cl.[3] ..... D05B 57/14

[52] U.S. Cl. ..... 112/231

[58] Field of Search ..... 112/231, 232, 181, 185, 112/189, 192

[56] References Cited

U.S. PATENT DOCUMENTS 1,989,594 1/1935 Gonyk ..... 112/231

2,655,885 10/1953 Kostro ..... 112/231 X

FOREIGN PATENT DOCUMENTS 607851 4/1926 France ..... 112/232

*Primary Examiner*—Richard J. Scanlan, Jr.

*Attorney, Agent, or Firm*—Oblon, Fisher, Spivak, McClelland & Maier

[57] ABSTRACT

A bobbin case for a shuttle having a rotary hook in which a plurality of pins for connecting an upper portion made of metal and a lower portion made of plastic are flexibly connected to the lower portion such that the pins may be slightly inclined upon contact between the upper portion and the pins due to vibrations transmitted from the rotary hook to the upper portion, thereby preventing generation of noise.

3 Claims, 6 Drawing Figures

BOBBIN CASE

BACKGROUND OF THE INVENTION

1. Field of the Invention

This invention relates to a bobbin case, and more particularly to a bobbin case on a shuttle around which a rotary hook is rotated.

2. Description of the Prior Art

Conventionally, a bobbin case is divided into an upper portion made of metal and a lower portion made of plastic so as to reduce the overall weight of the bobbin case. The upper portion is connected to the lower portion by screw means or similar connectors. More particularly, a non-tapped hole is provided in the upper portion, a tapped hole in alignment with the non-tapped hole is provided in the lower portion, and a screw is in turn driven into each of the holes. Thus, the upper portion is connected to the lower portion in such manner that the upper portion is fixed between the lower portion and the head of the screw. However, a clearance is formed between the screw and the non-tapped hole, with the result that the screw is brought into contact with the upper portion due to vibration transmitted from a rotary hook upon rotation thereof.

SUMMARY OF THE INVENTION

It is, therefore, one of the objects of this invention to provide a bobbin case without the aforementioned drawbacks of the prior art.

It is another object of this invention to provide a bobbin case in which a plurality of pins are flexibly connected to a lower portion made of plastics.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENT

Figure 1:
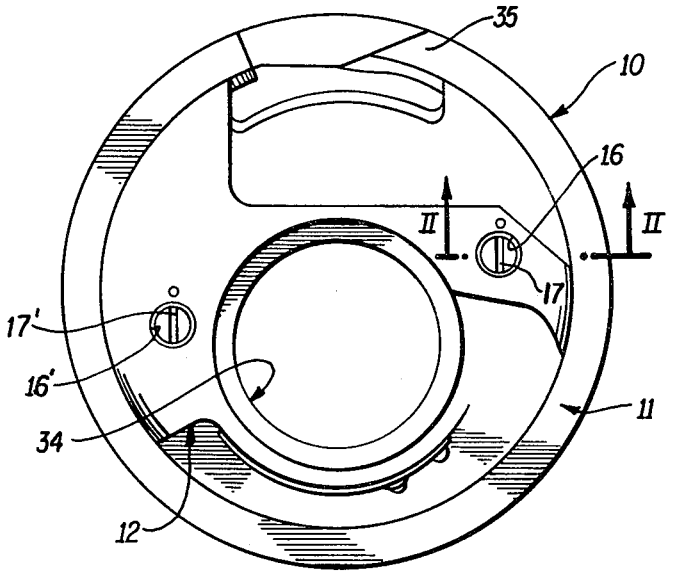
FIG. 1 is a plane view of a bobbin case in accordance with the present invention.
Figure 3:
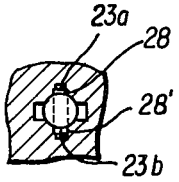
FIG. 3 is a view looking in the direction of arrow A.
Figure 5:
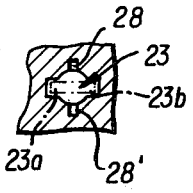
FIG. 5 is a view looking in the direction of arrow B.
Figure 2:
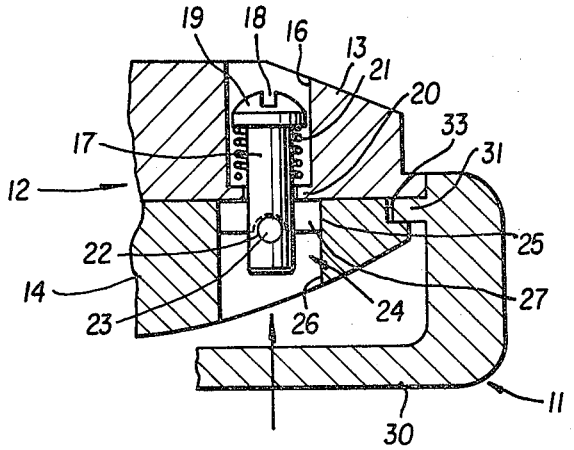
FIG. 2 is a sectional view taken along II—II of FIG. 1.
Figure 4:
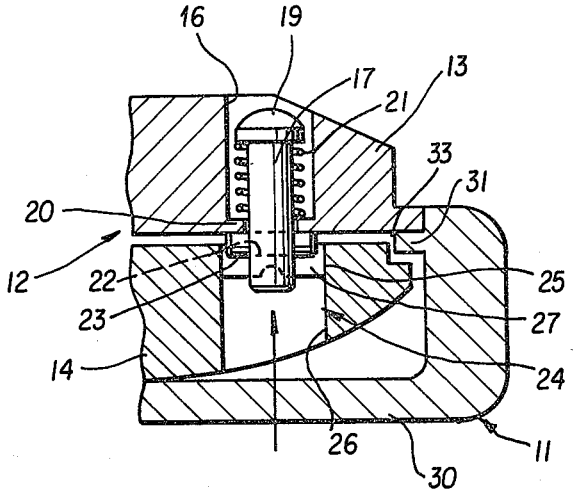
FIG. 4 is an explanatory drawing showing the assembly process of the bobbin case of FIG. 1.
Figure 6:
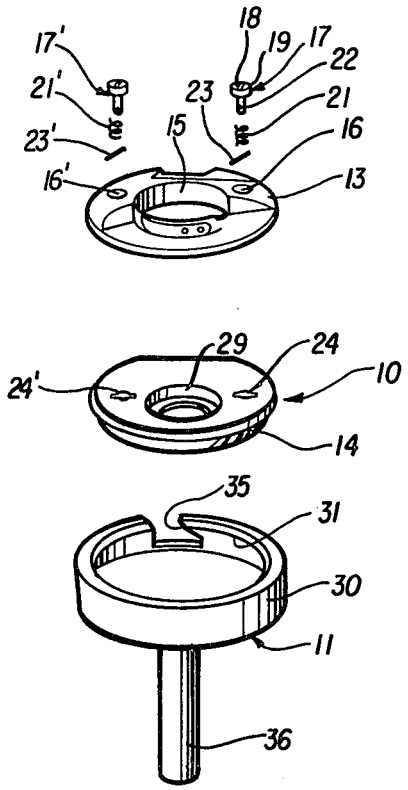
FIG. 6 is a perspective view of a disassembled bobbin case corresponding to the bobbin case of FIG. 1.

Referring now to FIGS. 1-6, a rotating shuttle 10 includes a rotary hook 11 and a bobbin case 12. Bobbin case 12 is divided into an upper portion 13 made of metal, and a lower portion 14 made of plastic. Upper portion 13 includes an opening 15 and a pair of spaced holes 16 and 16' for receiving, respectively, a pair of pins 17 and 17'. Hole 16 is provided with a stepped portion 20 at the lower side portion thereof. Pin 17 includes at an upper end portion thereof a head 19 with a radial groove 18.

A spring 21 is compressed between head 19 and stepped portion 20. A lower end portion of pin 17 has formed therein a radial hole 22 in which a key 23 is fitted. Opposite ends **23*a* and 23*b* are respectively projected from the other end portion of pin 17**.

Lower end portion 14 includes a second opening 29, and a pair of spaced holes 24 and 24' corresponding to opening 15 and both holes 16 and 16' respectively. Hole 24 includes a first portion 25 in which the other end portion of pin 17 and key 23 are movable vertically, a second portion 26 whose diameter is larger than the axial length of key 23, and a stepped portion 27 formed between the first and second portions 25 and 26.

Stepped portion 27 is formed with a pair of opposed seats 28 and 28' in the form of shallow grooves. Opposite ends **23*a* and 23*b* may be brought into engagement with seats 28 and 28', respectively, after 90° rotation of pin 17 while pin 17 is pushed against spring 21**.

An outer periphery portion of the upper portion 13 rests on an inner flange 31 which projects radially inwardly from a wall 30 of rotary hook 11. An outer periphery portion of lower portion 14 is so stepped that an annular groove 33 is formed for receiving flange 31 therein upon connection of upper and lower portions 13 and 14. First and second holes 15 and 29 form a bobbin receiving hole 34.

Rotary hook 11 further includes a hook portion 35 formed by notching wall 30, and a shaft 36 connected to a driving mechanism (not shown). Upon rotation of shaft 36, rotary hook 11 is rotated around bobbin case 12. Upon rotation of rotary hook 11, bobbin case 12 is slightly depressed by a retainer (not shown) such that bobbin case 12 may be maintained in a stationary condition.

In operation, during rotation of the rotary hook 11, vibration is transmitted to the upper portion 13 of the bobbin case 12 with the result that pins 17 and 17' are brought into contact with upper portion 13. However, pins 17 and 17' are flexibly connected to lower portion 14. Consequently, pins 17 and 17' are slightly inclined, thereby absorbing vibration, and noise is rarely generated.

Obviously, numerous additional modifications and variations of the present invention are possible in light of the above teachings. It is therefore to be understood that within the scope of the appended claim, the invention may be practiced otherwise than as specifically described herein.

What is claimed as new and desired to be secured by Letters Patent of the United States is:

1. A bobbin case for a shuttle around which a rotary hook is rotated, said bobbin case comprising:

an upper portion made of metal having a plurality of holes formed therein, each of said holes forming a stepped portion therein, a plurality of pins respectively mounted in said holes, each of said pins further comprising at an upper end portion and a lower end portion thereof, respectively, a head and a key, opposite ends of said key projecting from said lower end portion, a plurality of springs respectively being positioned adjacent said pins, each of said springs being compressed between said head and said stepped portion of each of said holes and a plastic lower portion having a plurality of holes formed therein corresponding to said holes of said upper portion, respectively, each of said holes of said lower portion including a first portion allowing vertical movement of said pin with said key against said spring, a second portion allowing rotation of said pin with said key therein, and a stepped portion formed between said first portion and said second portion, said stepped portion of said lower portion engaging said key after rotation of said pin.

2. A bobbin case according to claim 1, said head of said pin having a radial groove formed therein.

3. A bobbin case according to claim 1, said stepped portion of said lower portion further comprising a pair of opposed seats forming grooves for receiving, respectively, opposite ends of said key.

* * * * *